United States Patent [19]

Webinger

[11] 4,177,917

[45] Dec. 11, 1979

[54] CONTAINER COVER WITH INTERLOCKING FLAP CONFIGURATION

[75] Inventor: George P. Webinger, Minneapolis, Minn.

[73] Assignee: Champion International Corporation, Stamford, Conn.

[21] Appl. No.: 947,899

[22] Filed: Oct. 2, 1978

[51] Int. Cl.[2] ..... B65D 5/22

[52] U.S. Cl. ..... 229/34 HW; 229/41 D

[58] Field of Search ..... 229/34 HW, 41 C, 23 BT, 229/41 D

[56] References Cited

U.S. PATENT DOCUMENTS

| | | | |
|---|---|---|---|
| 1,492,951 | 5/1924 | Auerbach | 229/34 HW X |
| 2,085,238 | 6/1937 | Towell | 229/41 D |
| 2,242,741 | 5/1941 | Betts et al. | 229/34 HW |
| 2,819,833 | 1/1958 | Sauer | 229/41 C |
| 2,950,850 | 8/1960 | Corcoran | 229/34 R X |
| 3,122,298 | 2/1964 | Seger, Jr. | 229/41 C X |
| 3,178,227 | 4/1965 | Snyder | 229/41 D X |
| 3,325,079 | 6/1967 | Puckett | 229/34 HW |
| 3,765,598 | 10/1973 | Rosenburg, Jr. | 229/34 HW |
| 3,895,754 | 7/1975 | Rosenburg, Jr. | 229/34 HW X |

*Primary Examiner*—Davis T. Moorhead

*Attorney, Agent, or Firm*—Evelyn M. Sommer

[57] ABSTRACT

A container cover with straight sides having an interior interlocking flap configuration to adapt said cover to a taper-sided package tray comprising a center portion having vertical outer side walls equal in number to the tapered side walls of said package tray, a plurality of inner wall flaps each integrally formed with and hingedly attached along one edge thereof to a corresponding selected one of said vertical outer side walls and means integrally formed with said flaps for interlocking adjacent pairs of said flaps whereby when said flaps are folded inwardly into said cover, tapered, resilient, inner walls are formed to match and grasp the tapered sides of said package tray thereby centering said tray within said cover and maintaining said tray in its tapered configuration.

9 Claims, 5 Drawing Figures

CONTAINER COVER WITH INTERLOCKING FLAP CONFIGURATION

BACKGROUND OF THE INVENTION

Microwave ovens are coming into increasing use and it is stated by some that by 1980, one-fourth of all kitchens will have one. The widespread use of microwave ovens as a convenient and rapid cooking device has caused some problems in food packaging. Many of the convenience foods which could be advantageously cooked in microwave ovens are presently packed in aluminum trays which are suitable for use in regular ovens, but, are unsuitable for microwave ovens since, as is well known, microwaves bounce off metal and the deflected microwaves cause uneven cooking.

As a consequence, the food industry, to avoid packaging the same product in two different type containers, one for microwave and one for conventional ovens, has turned to containers made of special paper which is suitable for use in both types of ovens.

One style of container used for packaging, shipping, and cooking convenience foods in ovens in such container comprises a tray having sides that are sloped inwardly, thus forming a package tray which has an opening at the top that is smaller in diameter than its base. Such trays are difficult to handle during shipping inasmuch as the sloped side walls do not allow compact side-by-side stacking for shipping and storage purposes. Further, special covers are required for such trays because the side walls, which slope inwardly, do not hold themselves in their set-up configuration and require a cover which centers the tray within the cover and maintains the tray in its tapered configuration. Such special covers, when formed from more than one blank, means extra labor and costs which, of course, is borne ultimately by the consumer.

SUMMARY OF THE INVENTION

The present invention overcomes the problems of the prior art and provides a unique package cover for a package tray having side walls that are slanted inwardly. The cover has vertical outer side walls and integrally formed interlocking, interior flaps with attached spacer feet which, when set in position, form resilient, slanted, inner walls which match and grasp the slanted side walls of the package tray. These inner walls not only center the tray within the cover, but also maintain the tray in its tapered configuration.

Briefly stated, the invention relates to a container cover comprising a center portion having vertical outer side walls equal in number to the slanted side walls of a package tray, a plurality of inner wall flaps each integrally formed with and hingedly attached along one edge thereof to a corresponding selected one of said vertical outer side walls, and means integrally formed with said flaps for interlocking adjacent pairs of said flaps whereby when said flaps are folded inwardly into said cover, resilient, slanted, inner walls are formed to match and grasp the slanted side walls of said package tray thereby centering the tray within the cover and maintaining the tray in its tapered configuration. In a preferred embodiment the container is polygonal shaped and has two pair of interlocking adjacent flaps.

The invention further relates to a blank for forming a package cover for a tray having a hexagonal base and inwardly sloping, tapered sides, said cover having an interlocking flap configuration for forming slanted inner walls to match the slanted side walls of said package tray, said blank comprising a hexagonal center portion, a rectangular side wall panel integrally formed with and hingedly attached along one edge thereof to each side of said hexagonal center portion, a glue flap integrally formed with and hingedly attached to one side of each said side wall panel whereby when said side wall panels are erected in the vertical position with respect to said center portion, each of said glue flaps may be glued to the adjacent side wall panel thereby forming a straight sided package cover, first and second inner wall flaps being generally in the shape of a truncated isosceles triangle and having a tab projecting from one side thereof, said first and second flaps being integrally formed with and hingedly attached to the outer edges of first and second opposing ones of said side wall panels, third and fourth inner wall flaps having one side thereof in the shape of the side of the truncated isosceles triangle and the other side a vertical side with a recess therein for receiving said tab of an adjacent first or second inner wall flap, said third and fourth inner wall flaps being integrally formed with and hingedly attached to the outer edges of third and fourth opposing ones of said side wall panels whereby when said inner wall flaps are folded inwardly into said cover, said tab and recess cooperate to interlock said first and third and said second and fourth inner wall flaps, first and second generally rectangular glue panels integrally formed with and hingedly attached to the outer edges of opposing ones of the remaining side wall panels whereby said glue panels may be folded under said tray and glued thereto to maintain said tray within said cover, and feet means integrally formed with and hingedly attached to the outermost edge of said first, second, third and fourth inner wall flaps whereby when said inner wall flaps are folded inwardly into said cover, said feet means hold said flaps away from said outer vertical side walls to form resilient, slanted, inner walls matching and grasping the slanted sides of said package tray thereby centering the tray within said cover and maintaining said tray in its tapered configuration.

BRIEF DESCRIPTION OF THE DRAWINGS

These and other objects and advantages of the present invention will be disclosed in the course of the following specification, reference being had to the accompanying drawings in which.

DETAILED DESCRIPTION OF THE DRAWINGS

Figure 1:
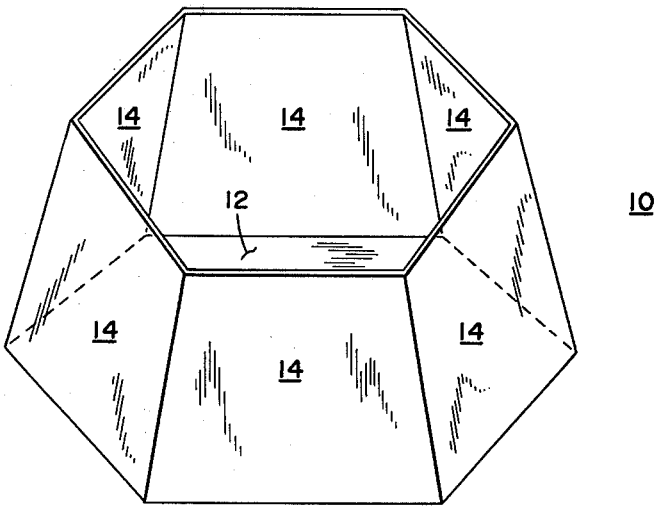
FIG. 1 is a perspective view of a package tray having slanted side walls to form a container for convenience foods which has a hexagonal top opening that is smaller than its hexagonal base.

FIG. 1 is a perspective view of the package tray for which the novel cover of the present invention is provided. The package tray itself is generally represented by the numeral 10 and has a polygonal base 12 in the form of a hexagon which has a tapered or slanted side wall 14 attached to each edge of the hexagonal base 12 thus forming a package tray container having a smaller hexagonal opening at the top than the hexagonal base. The tray does not hold itself in its set-up configuration and requires a package cover that centers the tray within the cover and maintains the tray in its tapered configuration. From FIG. 1, it can be readily understood that when such containers, packed with the manufacturer's product, are to be shipped, stacking becomes difficult because of the slanted side walls 14. Further, difficulties are encountered in making covers for such trays.

Figure 2:
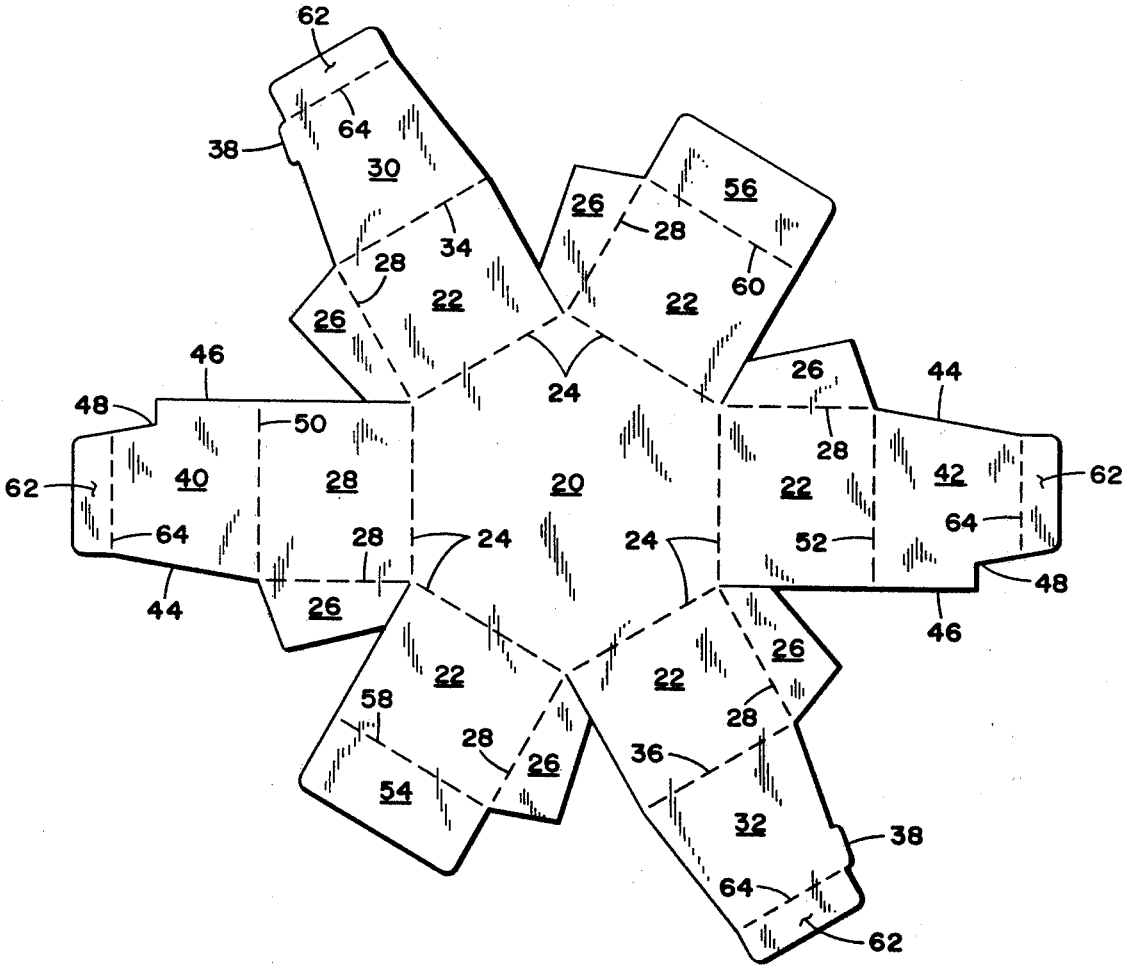
FIG. 2 is a plan view of a blank for forming a package cover with integrally formed interlocking flaps having attached spacer feet which, when set in position, are tapered inward in such a manner as to correspond with the slanted side walls of the package tray shown in FIG. 1.

FIG. 2 is a plan view of a blank which can be used to form a cover for said package tray having the slanted side walls and which overcomes the disadvantages of the prior art by enabling a cover to be formed with an interlocking flap configuration that forms slanted inner walls to match the slanted side walls of the package tray and yet has vertical or straight sided outer walls.

Figure 3:
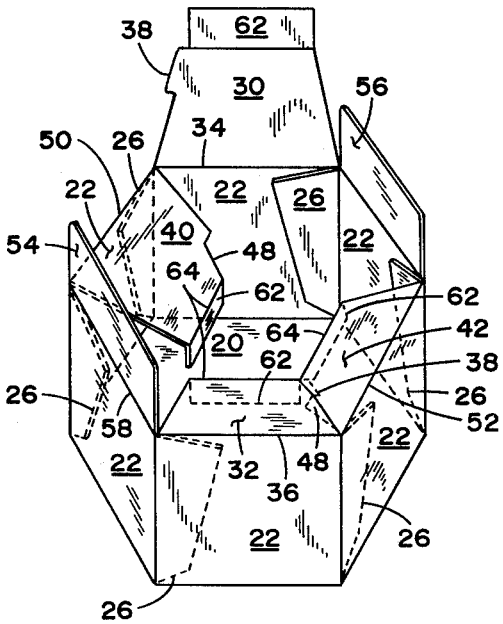
FIG. 3 is a perspective view of a partially folded package tray cover made from the blank shown in FIG. 2.

Thus, as shown in FIG. 2, the blank comprises a polygonal shaped center portion 20 which, in the preferred embodiment, is hexagonal in shape, has a rectangular side wall panel 22 integrally formed with and hingedly attached along edge 24 to each side of said center portion 20. A glue flap 26 is integrally formed with and hingedly attached to one side 28 of each of said side wall panels 22 whereby when the side wall panels 22 are erected in the vertical position with respect to center portion 20, each of the glue flaps 26 may be glued to the adjacent side wall panel 22 as shown in FIG. 3 thereby forming a straight sided package cover. First and second inner wall flaps 30 and 32 are generally in the shape of a truncated isosceles triangle and have a tab 38 projecting from one side thereof. First and second inner wall flaps 30 and 32 are integrally formed with and hingedly attached to the outer edges 34 and 36, respectively, of first and second opposing ones of said side wall panels 22. Third and fourth inner wall flaps 40 and 42 have one side 44 thereof in the shape of the side of a truncated isosceles triangle and the other side 46 thereof a vertical side with a recess 48 therein for receiving tab 38 of an adjacent first or second inner wall flap 30 or 32, respectively. The third and fourth inner wall flaps 40 and 42 are also integrally formed with and hingedly attached to the outer edges 50 and 52, respectively, of third and fourth opposing ones of said side wall panels 22. Thus, when said first, second, third and fourth inner wall flaps are folded inwardly into said cover, the tab 38 and recess 48 cooperate to interlock adjacent ones (first and third or second and fourth) of said inner wall flaps. Such interlocking arrangement of the overlapped flaps tends to hold the inner wall flaps within the cover. First and second generally rectangular glue panels 54 and 56 are integrally formed with and hingedly attached to the outer edges 58 and 60 of the remaining ones of opposing side wall panels 22 whereby said glue panels 54 and 56 may be folded under said tray 10 and glued thereto to maintain said tray 10 within said cover. The opposing forces caused by the interlocking flaps tending to be held toward outer sidewalls 22 and flap extensions 12 tending to push the interlocking flaps away from outer sidewalls 22 causes the inner walls to be resilient and tend to grasp the slanted side walls of the package tray. Flap extension or feet means 62 is integrally formed with and hingedly attached to the outermost edge 64 of each of said first, second, third and fourth inner wall flaps 30, 32, 40 and 42 whereby when said inner wall flaps are folded inwardly into said cover, said feet means 62 hold said flaps 30, 32, 40 and 42 away from said outer vertical side walls 22 to form slanted inner walls matching and grasping the slanted sides of the package tray which it covers. Further, these interlocking, resilient flaps center the tapered tray within the cover and maintain the tray in its tapered configuration.

FIG. 3 is a perspective view of the partially folded blank wherein each of the outer vertical side walls 22 have been erected to a vertical position with respect to the center portion 20. The glue flaps 26 have been glued to the adjacent side wall panels 22 to form a straight sided package cover. Glue panels 54 and 56 extend outwardly and inner wall flaps 32 and 42 have been folded inwardly with flap 32 overlapping flap 42 and tab 38 inserted in recess 48 and extending under inner wall flap 42. Flap extension or feet means 62 attach to both inner wall flaps 32 and 42 have been further folded inwardly about score lines 64. Inner wall flap 40 having recess 48 therein has been partially folded inwardly and the flap extension or feet means 62 has been folded about score line 64 preparatory to the entire flap 40 being folded completely inwardly within the partially formed cover. The final step would be to fold inner wall flap 30 inwardly about score line 34 so that flap 30 overlaps adjacent inner wall flap 40. Tab 38 on inner wall flap 30 would be inserted in recess 48 of flap 40 so that tab 38 is positioned under flap 40 in a similar manner to that shown for inner wall flaps 32 and 42.

Figure 4:
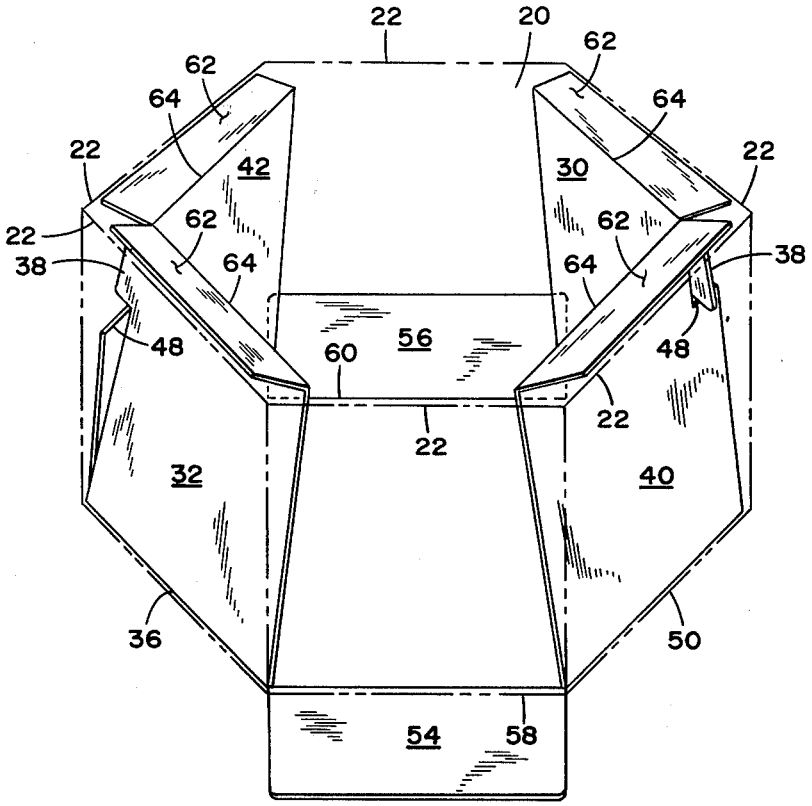
FIG. 4 is a partial perspective view of the novel package cover for a package tray having slanted side walls and showing the manner in which the inner wall flaps interlock and the spacer feet cause the inner walls to assume a slant position for matching and grasping the slanted side walls of the package tray.

FIG. 4 is a perspective phantom view of the package cover showing the straight outer walls in phantom so that the relationship of the inner wall flaps can be seen. Thus, the top 20 of the cover is in phantom as are the sides 22. The cover, as shown in FIG. 4, is in a position to be placed on the tray shown in FIG. 1. Each of the inner wall flaps 30, 32, 40 and 42 have been folded inwardly about the respective score line attaching them to their individual vertical side wall 22. Thus, inner wall flap 40 has been folded inwardly about score line 50 and inner wall flap 32 has been folded inwardly about score line 36. Glue panels 54 and 56 are prepared to fold under the tray 10 about score lines 58 and 60 and be glued to the base thereof. It can been seen that flap extension or feet means 62 hold inner wall flaps 30, 32, 40 and 42 away from vertical side walls 22, thus limiting the distance the side wall flaps can travel toward the outer vertical walls and causing slanted inner walls to be formed by inner wall flaps 30, 32, 40 and 42. Thus, flap 32 overlaps inner wall flap 42 with tab 38 inserted in recess 48 as an interlock which extends under inner wall flap 42. In like manner, inner wall flap 30 overlaps inner wall flap 40 and tab 38 which is attached to flap 30 is inserted in recess 48 as an interlock which extends under inner wall flap 40. The pressure maintained by flap extensions 62 aid in holding those flaps in their interlocked relationship and cause them to resiliently adapt to and grasp the package tray slanted side walls.

Thus, the tray is centered within the cover and maintained in its tapered configuration by means of the resilient, slanted, interlocking, inner wall flaps of the cover.

Figure 5:
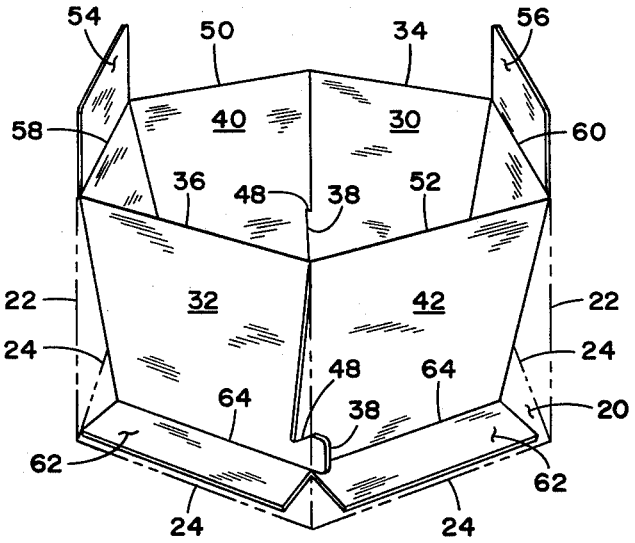
FIG. 5 is a partial perspective view of the novel cover in its inverted position illustrating the inner wall flaps in their interlocked position from a different angle.

FIG. 5 is a partially phantom perspective view of the cover in its inverted position. Thus, the center portion 20 is on the bottom of FIG. 5 and it and vertical outer side walls 22 are in phantom. Inner wall flaps 30, 32, 40 and 42 are folded inwardly about the respective fold lines 34, 36, 50, and 52. Flap 30 overlaps flap 40 with its associated tab 38 inserted in recess 48 of flap 40 as an interlock. In like manner, flap 32 overlaps inner wall flap 42 and tab 38 associated with flap 32 is inserted in recess 48 of flap 42 and extends under flap 42 as an interlock. Flap extensions or feet means 62 are folded inwardly about score line 64 and, as shown, form slanting inner walls by holding flaps 30, 32, 40 and 42 away from side walls 22. Also, as can be seen in FIG. 5, glue panels 54 and 56 extend outwardly so that when a tray 10 is inserted in said cover, the glue panels 54 and 56 may fold under the base of said tray 10 and be glued thereto to form a container secured for shipping and storage. The inner wall flaps resiliently grasp the slanted side walls of the package tray so that the tray is centered within the cover and maintained in its tapered configuration.

Thus, there has been disclosed a straight sided package cover with an interlocking inner flap configuration which forms slanted inner walls to match the slanted side walls of a package tray thereby providing a container which is easy to ship and which maintains a stacked relationship during shipping.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A container cover with straight outer side walls and having an interior, interlocking, flap configuration to adapt said cover to a taper-sided package tray, said cover comprising:

a. a center portion having vertical outer side walls equal in number to the slanted side walls of said package tray, b. a plurality of inner wall flaps each integrally formed with and hingedly attached along one edge thereof to a corresponding selected one of said vertical outer side walls, and c. means integrally formed with said flaps for interlocking adjacent pairs of said flaps whereby when said flaps are folded inwardly into said cover, resilient, slanted inner walls are formed to match and grasp the slanted sides of said package tray thereby centering said tray within said cover and maintaining said tray in its tapered configuration.

2. An interlocking flap configuration as in claim 1 further including:

a. a flap extension integrally formed with and hingedly attached to the outer edge of each of said inner wall flaps whereby when said inner wall flaps are folded inwardly into said cover, said flap extensions form feet which fold inwardly to hold said inner wall flaps away from said outer vertical side walls and form said resilient, slanted inner walls matching and grasping the slanted sides of said package tray.

3. An interlocking flap configuration as in claim 1 wherein said flap interlocking means comprises:

a. a tab and recess respectively formed in adjacent sides of said selected adjacent pairs of inner wall flaps whereby said flap with said tab overlaps said flap with said recess and said flaps are interlocked by inserting said tab in said recess.

4. An interlocking flap configuration as in claim 3 whereby each of said selected inner wall flaps having said tab is generally in the shape of a truncated isosceles triangle.

5. An interlocking flap configuration as in claim 4 further including:

a. a glue panel integrally formed with and hingedly attached along one edge to the remaining opposing ones of said vertical side walls of said cover whereby when said package tray is inserted into said cover, the glue panels are positioned under the base of said package tray and glued thereto to maintain said tray in said cover.

6. An interlocking flap configuration as in claim 1 wherein said cover has a hexagonal shape.

7. A blank for forming a package cover for a tray having a hexagonal base and inwardly sloping sides, said cover having an interlocking flap configuration for forming resilient, slanted inner walls to match and grasp the slanted side walls of said package tray, said blank comprising:

a. a hexagonal center portion, b. a rectangular side wall panel integrally formed with and hingedly attached along one edge thereof to each side of said hexagonal center portion, c. a glue flap integrally formed with and hingedly attached to one side of each of said side wall panels whereby when said side wall panels are erected in the vertical position with respect to said center portion, each of said glue flaps may be glued to the adjacent side wall panel thereby forming a straight sided package cover, d. first and second inner wall flaps being generally in the shape of a truncated isosceles triangle and having a tab projecting from one side thereof, said first and second flaps being integrally formed with and hingedly attached to the outer edges of first and second opposing ones of said side wall panels, e. third and fourth inner wall flaps having one side thereof in the shape of the side of a truncated isosceles triangle and the other side a vertical side with a recess therein for receiving said tab of an adjacent first or second inner wall flap, said third and fourth inner wall flaps integrally formed with and hingedly attached to the outer edges of third and fourth opposing ones of said side wall panels whereby when said inner wall flaps are folded inwardly into said cover, said tab and recess cooperate to interlock adjacent ones of said inner wall flaps and form resilient, inner wall flaps tending to be held towards said straight sides, f. first and second generally rectangular glue panels integrally formed with and hingedly attached to the outer edges of opposing ones of the remaining side wall panels whereby said glue panels are folded under a tray inserted in said cover and glued thereto to maintain said tray in said cover, and g. feet means integrally formed with and hingedly attached to the outermost edge of each of said first, second, third, and fourth inner wall flaps whereby when said inner wall flaps are folded inwardly into said cover, said feet means hold said flaps away from said outer vertical side walls to form slanted inner walls matching the slanted sides of said package tray.

8. A container cover with straight outer side walls and having an interior interlocking flap configuration to adapt said cover to a taper-sided hexagonal package tray, that cover comprising:

a. a hexagonal center portion having vertical outer side walls, b. two opposed pair of interlocking adjacent flaps, each flap integrally formed with and hingedly connected along one edge thereof to a corresponding selected one of said vertical outer side walls whereby when said flaps are folded inwardly into said cover, resilient, slanted inner walls are formed to match and grasp the slanted sides of said package tray thereby centering said tray within said cover and maintaining said tray in its tapered configuration, c. a glue panel integrally formed with and hingedly attached along one edge to the remaining opposing ones of said vertical side walls of said cover whereby said glue panels are folded under the base of said package tray and are glued thereto to maintain said tray within said cover, and d. a flap extension integrally formed with and hingedly attached to the outer edge of each of said inner wall flaps whereby when said inner wall flaps are folded inwardly into said cover, said flap extensions form feet which fold inwardly to hold said inner wall flaps away from said outer vertical side walls to form said resilient, slanted, inner walls for matching and grasping the slanted side walls of said package tray thereby centering and maintaining said tray in its tapered configuration.

9. A container cover with straight outer side walls and having an interior interlocking flap configuration to adapt said cover to a taper-sided hexagonal package tray, said cover comprising:

a. hexagonal center portion having vertical outer side walls, b. a first pair of adjacent inner wall flaps, each flap integrally formed with and hingedly attached along one edge thereof to adjacent selected ones of said vertical outer side walls, c. a second pair of adjacent inner wall flaps, each flap integrally formed with and hingedly attached along one edge thereof to adjacent selected ones of said vertical outer side walls opposing said first pair of flaps, d. a tab and recess respectively formed in adjacent sides of said flaps forming said first and said second pair of inner wall flaps whereby, in each pair, said flap with said tab overlaps said flap with said recess and said flaps are interlocked by inserting said tab in said adjacent recess, e. a flap extension integrally formed with and hingedly attached to the outer edge of each of said inner wall flaps whereby when said inner wall flaps are folded inwardly into said cover, said flap extensions form spacers which fold further inwardly to hold said inner wall flaps away from said outer vertical side walls and form resilient, slanted, inner walls matching and grasping the tapered sides of said package tray, and f. glue panels integrally formed with and hingedly attached along one edge thereof to the remaining opposing ones of said vertical side walls of said cover whereby said glue panels may be folded under the base of said tray and glued thereto to hold said tray securely within said cover for shipping and storage.

* * * * *